United States Patent [19]

Kelley et al.

[11] 4,040,944

[45] Aug. 9, 1977

[54] MANUFACTURE OF CATALYTIC CRACKING CHARGE STOCKS BY HYDROCRACKING

[75] Inventors: Arnold E. Kelley, Orange; Cloyd P. Reeg, Fullerton; Frederick C. Wood, Fullerton; George D. Cheadle, Fullerton, all of Calif.

[73] Assignee: Union Oil Company of California, Los Angeles, Calif.

[21] Appl. No.: 334,765

[22] Filed: Feb. 22, 1973

Related U.S. Application Data

[63] Continuation-in-part of Ser. No. 720,508, April 11, 1968, Pat. No. 3,728,251.

[51] Int. Cl.[2] ..... C10G 23/00

[52] U.S. Cl. ..... 208/89; 208/111

[58] Field of Search ..... 208/89, 111, 61, 120

[56] References Cited

U.S. PATENT DOCUMENTS

| | | | |
|---|---|---|---|
| 2,885,346 | 5/1959 | Kearby et al. | 208/61 |
| 2,932,611 | 4/1960 | Scott, Jr. et al. | 208/61 |
| 3,098,029 | 7/1963 | Snyder, Jr. | 208/61 |
| 3,159,564 | 12/1964 | Kelley et al. | 208/89 |
| 3,468,788 | 9/1969 | Wilkinson | 208/89 |
| 3,598,719 | 8/1971 | White | 208/89 |
| 3,728,251 | 4/1973 | Kelley et al. | 208/89 |

*Primary Examiner*—George Crasanakis
*Attorney, Agent, or Firm*—Lannas S. Henderson; Richard C. Hartman; Dean Sandford

[57] ABSTRACT

A desirably upgraded charge stock for catalytic cracking containing a relatively large proportion of heavy hydrocarbons boiling above about 800° F., is produced by first subjecting a raw feedstock boiling predominantly above 600° F. and containing a substantial proportion of material boiling above 800° F., to catalytic hydrofining followed by catalytic hydrocracking at high pressures in the presence of a Group VIB and/or Group VIII metal-promoted, crystalline zeolite hydrocracking catalyst. The hydrocracking catalyst and conditions are chosen so as to achieve selective conversion of material boiling between about 600° and 800° F. to lower boiling materials with a relatively minor conversion of the 800° F+ material. The resulting product boiling above 400° F is rich in 800° F+ material, and constitutes an excellent catalytic cracking charge stock.

7 Claims, 3 Drawing Figures

MANUFACTURE OF CATALYTIC CRACKING CHARGE STOCKS BY HYDROCRACKING

RELATED APPLICATIONS

This application is a continuation-in-part of Ser. No. 720,508, filed Apr. 11, 1968, now U.S. Pat. No. 3,728,251.

BACKGROUND AND SUMMARY OF THE INVENTION

In conventional, non-hydrogenative catalytic cracking it is well known that efficiencies, as measured by gasoline/coke ratios, depend to a large extent upon the nature of the feedstock employed. Feedstocks rich in nitrogen compounds, sulfur compounds and/or or heavy polycyclic condensed-ring aromatic hydrocarbons, tend to give relatively high coke and light gas yields and relatively low gasoline yields. Another significant factor is the boiling range distribution of the feed. Other things being equal, low boiling hydrocarbons generally require more severe conditions to maintain a given conversion to gasoline than do higher boiling hydrocarbons. If a feedstock boils over a wide range of say 400° to 1000° F., it is difficult to select a cracking temperature which is optimum for all hydrocarbon fractions in the feed. If high cracking temperatures are utilized in order to maintain adequate conversion of the lower boiling fractions, the higher boiling fractions then tend to produce inordinate amounts of coke and light gases. Conversely, if low temperatures are employed in order to optimize conversion of the heavy fractions and minimize coke formation, then conversion of the lower boiling fractions is reduced, resulting in low overall conversions per pass and high recycle rates.

In view of the above difficulties, considerable effort has been devoted in the past to upgrading and optimizing catalytic cracking feedstocks. Catalytic hydrofining has been suggested as a means of reducing the nitrogen and sulfur contents of such feeds, and also for partially hydrogenating heavy polycyclic hydrocarbons. In general it has been found that catalytic hydrofining is very successful for reducing sulfur and nitrogen contents, but when its use is extended to the partial hydrogenation of polyaromatics, overall desirable results appear to be limited to cases where the initial feedstock contains no more than a minor proportion of material boiling above about 800° F. For high boiling feedstocks, it is found that the severe hydrofining conditions required for denitrogenation, desulfurization and polyaromatics hydrogenation, inherently bring about a substantial conversion of the material boiling above about 800° F. to lower boiling hydrocarbons. This may in some cases be desirable, but in many cases it results in an undesirable production of large amounts of low octane gasoline in the hydrofiner, and also in an uneconomical consumption of hydrogen for the hydrocracking of heavy material which could more economically be converted in the catalytic cracker—and to a higher octane gasoline product.

Moreover, the conversion of 800° F.+ material during hydrofining results in a catalytic cracking feedstock much enriched in mid-boiling-range hydrocarbons (400°-800° F.), but still containing a "tail" of 800° F.+ material. For practical purposes this tail fraction must be removed from the cracking charge stock so that conditions can be optimized therein for conversion of the lower boiling materials, which conditions would otherwise result in excessive conversion of the tail fraction to coke. In summary therefore, it is difficult to utilize catalytic hydrofining alone to effect adequate upgrading and optimizing of cracking feedstocks containing substantial amounts of material boiling above about 800° F.

It has also been suggested in the art that unconverted oils boiling above the gasoline range resulting from catalytic hydrocracking operations utilizing conventional metal-promoted silica-alumina cogel type catalysts, can also be utilized as catalytic cracking charge stocks. Although these unconverted oils do in many instances form advantageous cracking feedstocks, it has been found that in general they suffer from the same limitations as do the severely hydrofined oils discussed above. The amorphous cogel type hydrocracking catalysts tend, like hydrofining catalysts, to convert selectively the heavy portions of the feed, giving a product rich in mid-boiling-range hydrocarbons, but lean in heavy ends. Here again, economical operation of the catalytic cracker generally requires removal of the heavy ends, thus again effectively limiting upgraded charge stocks to an end-point of about 800° F.

A primary objective of the present invention is to provide a process for upgrading catalytic cracking charge stocks which contain substantial proportions, e.g., at least about 20 weight-percent, of material boiling above 800° F., in such manner as to minimize hydrogen consumption, the production of low octane hydrogenated gasolines, and to provide a denitrogenated, desulfurized and partially hydrogenated cracker charge stock which includes a sufficient amount of heavy material boiling above about 800° F. to justify the use of cracking temperatures aimed more at the conversion of the heavy fraction under relatively non-coking conditions, while still maintaining a relatively high overall conversion per pass to gasoline. Conventional catalytic hydrocracking cycle oils (from which the 800° F.+ fraction has not been removed) when cracked at the same low severity levels give low conversions and high recycle rates; and if cracking temperatures are raised to achieve adequate conversions, coking rates and dry gas yields are materially increased.

According to our invention, the initial raw heavy feedstock is first subjected to catalytic hydrofining to a limited extent necessary to reduce the sulfur and nitrogen contents to the desired level, but insufficient to complete the desired hydrogenation of polyaromatics, and final upgrading of the product is carried out under mild hydrocracking conditions over a specific type of hydrocracking catalyst which is effective for the partial hydrogenation of polyaromatics, but due to its pore size limitations, selectively hydrocracks material boiling in the 600° - 800° F. range, but effective minimal hydrocracking of the 800° F+ material. The resulting product fraction boiling above about 600° F., and even in some cases the entire product fraction boiling above an initial temperature as low as 400° F., can then be catalytically cracked at relatively low temperatures selected for optimum conversion of the 700° F.+ , or 800° F. + material while maintaining desirably high overall conversion rates and low coke yields. This result can be achieved primarily because the unique hydrocracking step has materially reduced the amount of 600° - 800° F. boiling range material in the feed while effecting a relatively insignificant reduction in the content of 800° F.+ material.

Moreover, a fortuitous aspect of the invention is that the minor proportion of $C_6$-400° F. gasoline synthesized in the hydrocracking step has an unusually high octane number, a result which is believed attributable to the aromaticity of the initial feed from which it was derived. The hydrocracked product fraction boiling in the 400° - 600° F. range is also highly aromatic in nature and may hence be advantageously recycled to the hydrocracking step, or separately hydrocracked to produce additional high octane hydrocracked gasoline. Alternatively, since the aromatics in this fraction are predominantly monoaromatics, it can advantageously be included in the feed to the catalytic cracker without materially decreasing conversion levels at a given coke yield.

DESCRIPTION OF DRAWINGS

Reference is now made to the attached FIGS. 1 and 2 for a graphic illustration of the differing product distributions obtained in the hydrocracking of a heavy, hydrofined feedstock with a zeolite hydrocracking catalyst and with an amorphous cogel catalyst.

The hydrofined feedstock is described more particularly hereinafter in the preface to the Examples, while the zeolite catalyst and hydrocracking conditions are described in Example 2. The illustrative amorphous cogel catalyst of FIG. 2 is an 87/13 weight-percent cogel of silica and alumina containing 0.5 weight-percent of impregnated palladium. The hydrocracking conditions in FIG. 2 are adjusted to give substantially the same conversion to $C_6$–400° F. gasoline as in FIG. 1. In FIG. 1 it will be noted that about 46.5 weight-percent of the 600° F.+ product boiled above 800° F., and the total amount of 400° - 600° F. product was only about 24.5 weight-percent of the total. In FIG. 2 however, only about 33 weight-percent of the 600° F.+ product boils above 800° F., and about 34 weight-percent of the total product boils between 400° and 600° F. For reasons discussed above, in most catalytic cracking operations, the 600° F.+ product of FIG. 1 is preferable to the 600° F.+ product of FIG. 2. The same is true of the 400° F.+ product of FIG. 1 as compared to the 400° F.+ product of FIG. 2.

Figure 3:
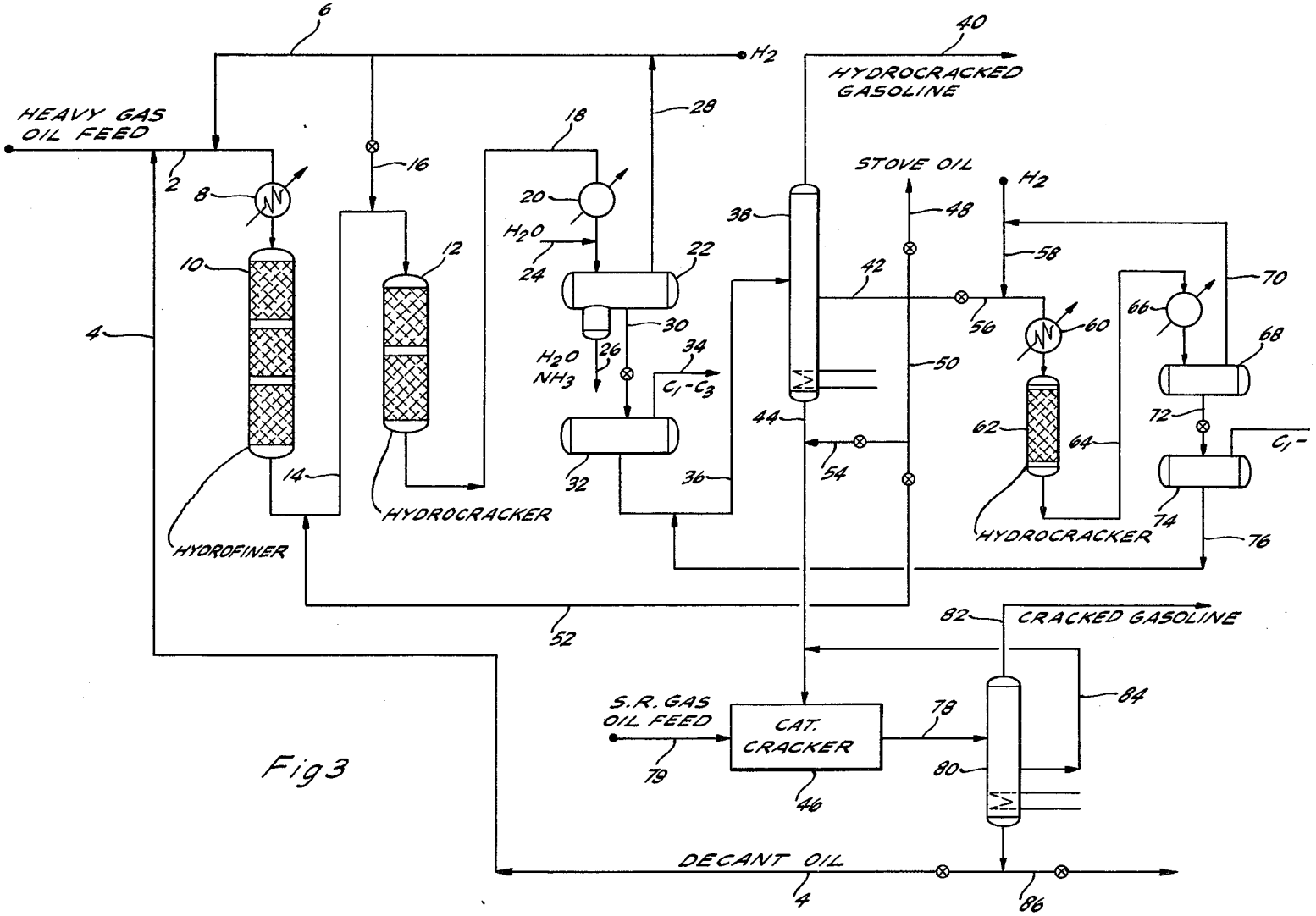

Reference is now made to the attached FIG. 3 which is a simplified flow diagram illustrating one specific application of the invention, and four alternative modes of utilizing the 400° - 600° F. fraction of the hydrocracked product oil. Initial raw feed comprising for example heavy coker gas oil in line 2, is blended with recycle and makeup hydrogen from line 6, the mixture then being passed via preheater 8 into the top of catalytic hydrofiner 10, containing a suitable hydrofining catalyst disposed therein. The hydrofining catalyst may be conventional, comprising a minor proportion of a Group VIB and/or Group VIII metal oxide and/or sulfide supported on a difficultly reducible mineral oxide carrier such as activated alumina, silica gel, activated clays and the like. Preferably the carrier should have a low cracking activity, corresponding to a Cat-A Activity Index below about 20. Preferred hydrofining catalysts comprise a minor proportion of a Group VIB metal sulfide, e.g., molybdenum, and a minor proportion of an Iron Group metal sulfide, e.g., nickel, supported on an activated alumina carrier. Operative hydrofining conditions may be selected from the following ranges:

| HYDROFINING CONDITIONS | Broad Range | Preferred Range |
|---|---|---|
| Temperature, ° F. | 650 - 875 | 725 - 850 |
| Pressure, psig | 1000 - 5000 | 2000 - 4000 |
| $H_2$ Partial Pressure, psi | 800 - 3000 | 1500 - 2500 |
| LHSV | 0.2 - 10 | 0.4 - 2.0 |
| $H_2$/Oil Ratio, MSCF/B | 2 - 20 | 4 - 12 |

It will be noted that the above pressure ranges are somewhat higher than conventional hydrofining pressures; the higher pressures are required herein in order to maintain adequate catalyst life using the heavy feedstocks required. The overall objective is to obtain the desired denitrogenation and desulfurization, normally at least 80 percent denitrogenation and at least 90 percent desulfurization, while at the same time limiting feed conversion to low levels, such that not more than about 20 volume-percent and preferably less than 10 volume-percent of $C_6$–400° F. gasoline is synthesized.

In the modification illustrated, total effluent from hydrofiner 10 is transferred to hydrocracker 12 via line 14, without intervening cooling, condensation or separation of ammonia and hydrogen sulfide generated in the hydrofiner. Additional makeup hydrogen and recycle gas may be added via line 16 if needed. Hydrocracker 12 contains a suitable bed or beds of zeolite hydrocracking catalyst to be described hereinafter. Suitable hydrocracking conditions may be selected from the following ranges.

| HYDROCRACKING CONDITIONS | Broad Range | Preferred Range |
|---|---|---|
| Temperature, ° F. | 650 - 875 | 725 - 850 |
| Pressure, psig | 1000 - 5000 | 2000 - 4000 |
| $H_2$ Partial Pressure, psi | 800 - 3000 | 1500 - 2500 |
| LHSV | 0.5 - 15 | 1.5 - 10 |
| $H_2$/Oil Ratio, MSCF/B | 2 - 20 | 4 - 12 |

The above conditions are suitably adjusted and correlated so as to synthesize in the hydrocracker only between about 5 percent and 30 percent, preferably 8–25 percent by volume of $C_6$–400° F. gasoline, based on initial feedstock. At these low conversion levels only sufficient hydrogenation takes place to increase the hydrogen content of the 600° F.+ hydrofined product fraction by about 2–30 percent, usually between about 4 percent and 20 percent by weight. As a result, the total saturates content (paraffins and naphthenes) of the 600° F.+ fraction is increased by about 5–50 percent by weight and its API gravity is generally increased by about 5–20 percent. It should be noted however, that in many cases, substantial hydrogenation and saturation of the 600° F.+ fraction can be achieved with little or no increase in gravity of the fraction. This is due to the selective conversion of material in the 600° - 800° F. range as opposed to conversion of the 800° F.+ material, resulting in a 600° F.+ product of higher average molecular weight.

Effluent from hydrocracker 12 is transferred via line 18 and condenser 20 to high-pressure separator 22, after being admixed with wash water injected via line 24. From separator 22, spent wash water containing dissolved ammonia and some hydrogen sulfide is withdrawn via line 26, while recycle hydrogen is withdrawn and returned to the reactors via lines 28 and 6. Liquid condensate in separator 22 is then flashed via line 30 into low-pressure separator 32, from which light gases are exhausted via line 34. Low-pressure condensate in separator 32 is then transferred via line 36 to fractionating column 38 wherein desired product fractions are recovered.

In the modification illustrated, column 38 is used to recover a total 400° F. end-point gasoline overhead via line 40, a 400° - 600° F. boiling range side-cut via line 42, and a 600° F.+ bottoms fraction via line 44, constituting the primary feedstock to catalytic cracker 46. The side-cut fraction in line 42 may be utilized in four different alternates, or any desired combination thereof. According to one alternate, it may be withdrawn from the process via line 48 and utilized for stove oil, furnace oil or the like. According to another alternate, it may be recycled via lines 50 and 52 to hydrocracker 12 where it is ultimately converted to hydrocracked gasoline recovered via line 40. According to the third alternate, it may be diverted via lines 50 and 54 to catalytic cracking unit 46 for conversion to gasoline. According to the fourth alternate, it is blended in line 56 with recycle gas and makeup hydrogen from line 58, preheated in heater 60 and passed through second-stage hydrocracker 62 for conversion to gasoline. Effluent from hydrocracker 62 is then transferred via line 64 and condenser 66 to high-pressure separator 68, from which recycle hydrogen is recovered via line 70, while the condensed liquid product is flashed via line 72 into low-pressure separator 74. Flashed condensate from separator 74 is then returned to fractionating column 38 via lines 76 and 36 for recovery of second-stage gasoline via line 40, and unconverted oil via line 42.

As those skilled in the art will readily understand, the selection of the various alternates for the side-cut fraction in line 42 will depend upon a great many economic variables, as well as the nature of the feedstock employed. In most cases however it will be found that conversion to gasoline in hydrocracker 12 or hydrocracker 62 will be preferred, mainly because of the relatively high quality gasoline produced as a result of the aromatic character of the side-cut. Recycling to hydrocracking 12 tends to reduce the efficiency of this unit for its primary purpose of upgrading the catalytic cracker charge stock, but may nevertheless be the preferred mode for small units where a second stage hydrocracker cannot be justified. For large installations however, a second-stage hydrocracker may be preferred because it upgrades in the absence of ammonia which is present in hydrocracker 12. As a result, hydrocracker 62 can operate more efficiently for gasoline conversion at temperatures generally 50–150° F. lower than those prevailing in hydrocracker 12.

Catalytic cracking unit 46 may be a conventional fluid catalytic cracker or a moving bed process, e.g., of the TCC type, or any other conventional type. In addition to the primary hydrocracked feedstock from line 44, other extraneous feeds may be processed therein, typically a straight run gas oil brought in via line 79. Cracking is carried out under conventional conditions at temperatures of 850° -1150° F., 0.1 - 10 LHSV, and at pressures of, e.g., 0–100 psig. Conventional cracking catalysts consisting of coprecipitated silica-alumina, silica-zirconia, silica-magnesia and/or crystalline zeolites of the type hereinafter described for use as hydrocracking catalyst bases may be utilized. Typical conversions to gasoline range between about 30–70 volume-percent per pass, with low coke yields in the range of about 0.5 - 4 weight-percent of feed.

Condensed liquid product from the cracking unit is transferred via line 78 to fractionating column 80 from which cracked gasoline product is withdrawn overhead via line 82, while a side-cut of recycle oil, normally boiling up to about 800° F. is recycled via line 84. If desired, a portion of this recycle oil can be diverted to hydrocracker 12 or 62 for conversion to gasoline and/or upgraded feed to cracker 46. A heavy bottoms fraction boiling above about 800° F., normally referred to as "decant oil" may be recovered via line 4 and recycled in whole or in part to hydrofiner 10. However, in cases where little or no refractory extraneous feeds are fed to cracker 46, this decant oil may be almost nonexistant due to the excellent cracking characteristics of the hydrocracked feed from line 44. In such cases, as well as others, it may be preferable to withdraw part or all of the decant oil from the process via line 86 and utilize it in other refinery processing which does not require complete separation of catalyst fines and coke therefrom, e.g., in delayed coking or as fuel oil.

Many variations in the above described processing scheme are contemplated herein. Although it is normally desirable to operate hydrofiner 10 and hydrocracker 12 integrally as shown, i.e., without intervening condensation, depressuring or purification of the hydrofiner effluent, it is also contemplated that the hydrofining and hydrocracking operations may be carried out non-integrally with intervening treatment of the hydrofiner effluent to remove ammonia, hydrogen sulfide and the like. In this case, hydrocracker 12 can be operated at substantially reduced temperatures and/or higher space velocities.

FEEDSTOCKS

Advantageous feedstocks for use in the present process are in general limited to heavy, substantially aromatic mineral oil fractions which also contain substantial amounts of organic sulfur and/or nitrogen compounds. Specifically, it is preferred that the raw feed contain at least about 20 weight-percent of material boiling above 800° F., and less than about 20 weight-percent of material boiling below 600° F. The total aromatics content (including heterocyclic compounds) should be at least about 20 and preferably at least about 50 weight-percent. Total sulfur contents may range between about 0.1 and 5 weight-percent, and nitrogen contents between about 0.01 and 2 weight-percent. Specifically preferred feedstocks include for example catalytic and/or thermal cracking cycle oils and/or decant oils, light, medium, and heavy coker gas oils, straight-run vacuum distillates, deasphalted crude oil residua and the like, as well as mixtures thereof. These oils may be derived from petroleum crude oils, shale oils, tar sand oils, coal hydrogenation products, and the like. The gravity of the feed will normally range between about −5° and 20° API.

HYDROCRACKING CATALYSTS

The unique hydrocracking catalysts employed herein comprise a major proportion of a crystalline, aluminosilicate zeolite cracking base upon which is deposited, as by ion-exchange and/or impregnation, a minor proportion of a hydrogenating component selected from the class consisting of the Group VIB and Group VIII metals and their oxides and sulfides. The zeolite cracking bases, commonly referred to in the art as molecular sieves are composed usually of silica, alumina and one or more exchangeable cations such as sodium, hydrogen, magnesium, rare earth metals, etc. They are further characterized by crystal pores of relatively uniform diameter between about 4 and 14 A. It is preferred to employ zeolites having a relatively high $SiO_2/Al_2O_3$ mole-ratio, between about 2.0 and 12, and even more preferably between about 3 and 8. Suitable zeolites found in nature include for example mordenite, stilbite, heulandite, ferrierite, dachiardite, chabazite, erionite, and faujasite. Suitable synthetic zeolites include for examples those of the Y, X and L crystal types, or synthetic forms of the natural zeolites noted above, especially synthetic mordenite. The preferred zeolites are those having crystal pore diameters between about 8–12 A, and wherein $SiO_2/Al_2O_3$ mole-ratio is about 3–6. A prime example of a zeolite falling in this preferred group is the synthetic Y molecular sieve.

The naturally occurring zeolites are normally found in a sodium form, an alkaline earth metal form, or mixed forms. The synthetic zeolites normally are prepared first in the sodium form. In any case, for use a cracking base it is preferred that most or all of the original zeolitic monovalent metals be ion-exchanged out with a polyvalent metal, and/or with an ammonium salt followed by heating to decompose the zeolitic ammonium ions, leaving in their place hydrogen ions and/or exchange sites which have actually been decationized by further removal of water as described in U.S. Pat. No. 3,130,006:

$$(NH_4+)_xZ \rightarrow (H+)_xZ + xNH_3 \quad (1)$$

$$(H+)_xZ \rightarrow Z + (x/2H_2O \quad (2)$$

The hydrogen zeolites, the decationized zeolites, and the mixed forms, are designated herein as being "metal-cation-deficient." The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion-exchange capacity is satisfied by hydrogen ions, and at least about 20 percent by polyvalent metal ions such as magnesium, calcium, zinc, rare earth metals, etc.

Mixed polyvalent metal-hydrogen zeolites may be prepared by ion-exchanging first with an ammonium salt, then partially back-exchanging with a polyvalent metal salt, and then calcining. In some cases, as in the case of synthetic mordenite, the hydrogen forms can be prepared by direct acid treatment of the alkali metal sieves.

The preferred metals employed herein as hydrogenation components on the zeolite cracking bases are the noble metals of Group VIII, i.e., ruthenium, rhodium, palladium, osmium, iridium and platinum, or mixtures thereof. Particularly preferred metals are palladium and platinum. Other hydrogenating metals which may be utilized include the Iron Group metals, e.g., nickel or cobalt, and the Group VIB metals, e.g., molybdenum or tungsten, and mixtures thereof. The amount of hydrogenating metal may vary widely between about 0.05 and 20 weight-percent. When using Group VIII noble metals, preferred amounts range between about 0.1 and 3 percent.

The preferred method of adding the hydrogenating metal is by ion-exchange. This is accomplished by digesting the zeolite, preferably in its ammonium form, with an aqueous solution of a suitable compound of the desired metal or metals, wherein the metal is present in a cationic form, as described for example in U.S. Pat. No. 3,336,762.

Following addition of the hydrogenating metal, the resulting catalyst powder is then filtered off, dried, pelleted with added lubricants, binders, or the like if desired, calcined at temperatures of, e.g., 700° – 1,200° F. in order to activate the catalyst and decompose zeolitic ammonium ions. The foregoing catalysts may be employed in undiluted form, or the powdered catalyst may be mixed and copelleted with other relatively less active adjuvants, diluents or binders such as activated alumina, silica gel, coprecipitated silica-alumina cogel, magnesia, activated clays and the like in proportions ranging between about 5 percent and 50 percent by weight. These adjuvants may be employed as such, or they may contain a minor proportion of an added hydrogenating metal, e.g., a Group VIB and/or Group VIII metal.

The following examples are cited to illustrate the invention and the results obtainable, but are not to be construed as limiting in scope:

PREFACE TO EXAMPLES

In all of the following examples, the hydrofining catalyst used was a presulfided composite of about 3 weight-percent NiO, 0.2 weight-percent CoO, and 16 weight-percent $MoO_3$ impregnated upon ⅛-inch pellets of activated alumina containing about 5 weight-percent of coprecipitated silica gel. The hydrocracking catalyst was a copelleted composite of about 80 weight-percent of a Y zeolite containing 1.0 weight-percent palladium, and about 20 weight-percent of an activated alumina binder. The Y zeolite cracking base had a $SiO_2/Al_2O_3$ mole-ratio of about 4.7, about 35 percent of the zeolite ion exchange capacity being satisfied by magnesium ions (3 weight-percent MgO), about 10 percent by sodium ions, and the remainder by hydrogen ions.

The initial feedstock to the hydrofiner was in all cases a blend composed of 16 percent fluid catalytic cracker decant oil, 14 percent heavy coker gas oil and 70 percent light coker gas oil by volume. The principal characteristics of the feed components and the blend were as follows:

Table 1

| | Decant Oil | Heavy, Coker Gas Oil | Light Coker Gas Oil | Feed Blend |
|---|---|---|---|---|
| Gravity, ° API | −4.2 | 7.9 | 13.9 | 9.4 |
| Hydrogen Content, wt-% | — | — | — | 9.73 |
| Sulfur, wt-% | 2.6 | 3.6 | 3.6 | 3.3 |
| Nitrogen, wt-% | 0.068 | 0.445 | 0.304 | 0.355 |
| Carbon residue Conradson, wt-% | 12.4 | 7.3 | 1.24 | 2.52 |
| ASTM Distillation, ° F. | | | | |
| 10% | 756 | 864 | 620 | 633 |
| 50% | 855 | 973 | 765 | 818 |
| 90% | 973 | 1034 | 915 | 986 |
| Total Aromatics, wt-% (Universal high mass) | 87.7 | 75.1 | 76.6 | 75.7 |

In the following examples, the principal objective was to achieve at least 90 percent desulfurization and denitrogenation of the feed blend, and to upgrade the 600°

F.+ product to a gravity of at least 22° API while maintaining therein a maximum ratio of material boiling above 800° F. to material boiling in the 600° -800° F. range.

EXAMPLE 1

In two parallel runs, the feed blend was subjected to catalytic hydrofining at differing space velocities in an attempt to achieve the above objectives. The conditions and results of the runs were as follows:

Table 2

| Run No. | 1 | 2 |
|---|---|---|
| Temperature, ° F. | 780 | 780 |
| Pressure, psig | 2500 | 2500 |
| LHSV | 0.78 | 0.59 |
| $H_2$Oil Ratio, MSCF/B | 7.9 | 7.9 |
| $C_6$+ Liquid Yields, Vol-% | | |
| $C_6$-185° F. | 0.9 | 1.0 |
| 185-400° | 6.0 | 8.7 |
| 400-600° | 24.9 | 28.6 |
| 600°+ | 73.2 | 67.9 |
| Product Properties | | |
| 185-400° F. Fraction | | |
| Aromatics, Vol-% | 35 | 41 |
| 400-600° F. Fraction | | |
| Aniline Point, ° F. | 90.0 | 96.4 |
| Gravity, °API | 27.4 | 27.9 |
| 600° F.+ Fraction | | |
| Gravity, °API | 20.5 | 22.5 |
| Hydrogen Content, wt-% | 11.83 | 11.93 |
| Sulfur, ppm | 319 | 107 |
| Nitrogen, ppm | 210 | 100 |
| Total Aromatics, wt-% | 62.9 | 56.7 |
| Gas Chromatograph Simulated Distillation of Full-Range Product, Wt-% | | |
| $C_1$-$C_6$ | 0.39 | 0.65 |
| $C_7$-300° F. | 2.31 | 3.50 |
| 300-400° | 3.41 | 4.42 |
| 400-500° | 8.82 | 10.20 |
| 500-600° | 16.72 | 17.14 |
| 600-700° | 23.85 | 24.66 |
| 700-800° | 18.38 | 16.21 |
| 800-900° | 14.08 | 12.81 |
| 900°+ | 12.04 | 10.41 |
| Ratio of Fractions, 800° F.+/600-800° F. | 0.617 | 0.565 |

The principal point to note from the foregoing data is that, to achieve the desired gravity of 22.5° F. of the 600° F.+ fraction in Run 2 (by using a relatively low space velocity), it was necessary to accept a substantially reduced ratio of 800° F.+/ 600° - 800° F. fractions. Thus, the increased gravity of the 600° F. product in Run 2 resulted mainly from selective cracking of the 800° F.+ fraction with a minimum of net hydrogenation, as is reflected in the relatively insignificant increase of 0.9 percent in hydrogen content of the fraction. The following examples show that an opposite result is achieved when the desired hydrogen content and gravity is reached by the hydrofining-hydrocracking process of this invention.

EXAMPLE 2

The feed blend was subjected to "integral" hydrofining-hydrocracking, with the hydrofiner effluent passing directly through the hydrocracking catalyst bed without intervening condensation or separation of products, process conditions and results being as follows:

Table 3

| Run No. | 3 | |
|---|---|---|
| | Hydrofiner | Hydrocracker |
| Temperature, ° F. | 780 | 780 |
| Pressure, psig | 2500 | 2500 |

Table 3-continued

| Run No. | 3 | |
|---|---|---|
| LHSV | 0.78 | 2.35 |
| $H_2$/Oil Ratio, MSCF/B | 8.13 | 8.13 |
| $C_6$+ Liquid Yields, Vol-% | | |
| $C_6$-185° F. | — | 2.5 |
| 185-400° | — | 17.3 |
| 400-600° | — | 26.1 |
| 600°+ | — | 56.7 |
| Product Properties | | |
| 185-400° F. Fraction | | |
| Aromatics, Vol-% | — | 39 |
| 400-600° F. Fraction | | |
| Aniline Point, ° F. | — | 74 |
| Gravity, °API | — | 26.6 |
| 600° F.+ Fraction | | |
| Gravity, °API | ~20 | 22.1 |
| Hydrogen Content, Wt-% | — | 12.25 |
| Sulfur, ppm | — | 538 |
| Nitrogen, ppm | — | 120 |
| Total Aromatics, Wt-% | — | 44.8 |
| Gas Chromatograph Simulated Distillation of Full-Range Product, Wt.-% | | |
| $C_1$-$C_6$ | 0.73 | 2.26 |
| $C_7$-300° F. | 2.25 | 7.34 |
| 300-400° | 2.88 | 6.25 |
| 400-500° | 7.64 | 11.21 |
| 500-600° | 14.60 | 15.69 |
| 600-700° | 22.74 | 16.62 |
| 700-800° | 19.55 | 14.15 |
| 800-900° | 14.62 | 12.80 |
| 900°+ | 14.99 | 13.68 |
| Ratio of Fractions, 800° F.+/600-800° F. | 0.70 | 0.861 |

Figure 1:
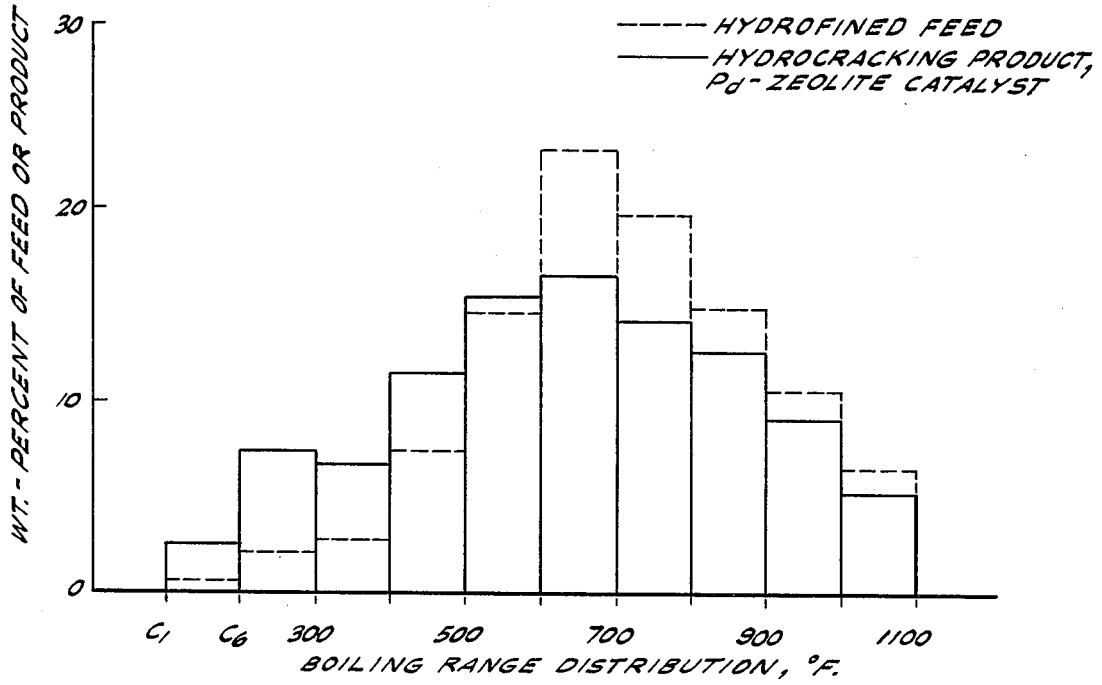
FIG. 1 is a bar graph depicting feed and product boiling range distributions obtained with the zeolite catalyst.
Figure 2:
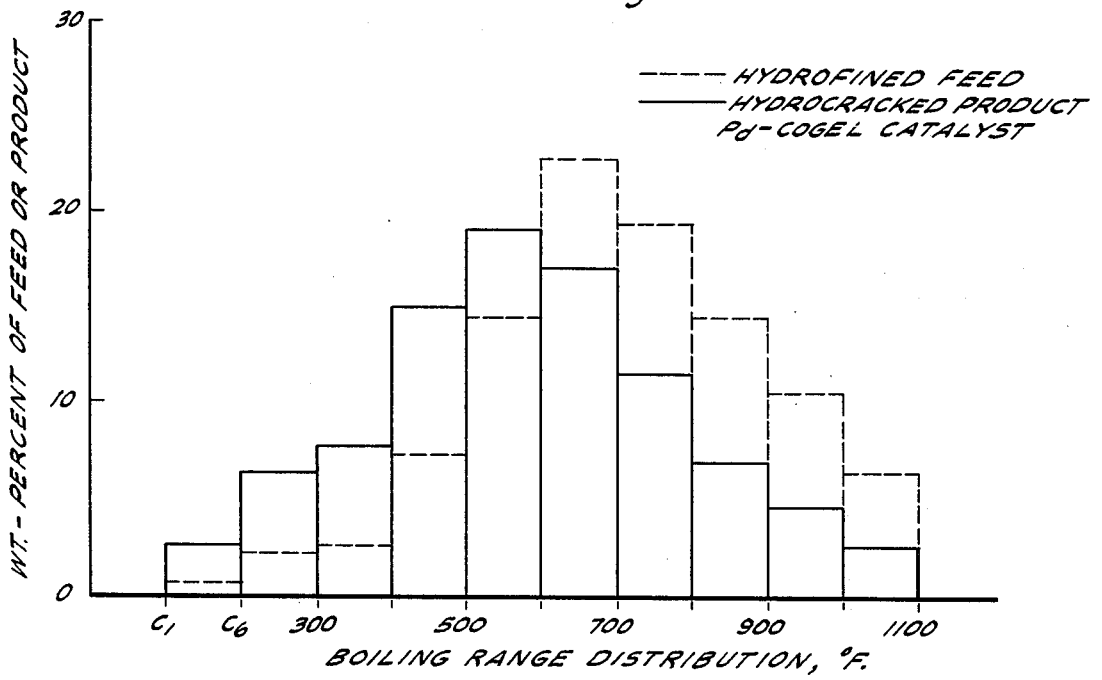
FIG. 2 is a bar graph depicting feed and product distributions obtained with an amorphous cogel catalyst when used for hydrocracking the same hydrofined feed of FIG. 1.

In this instance, it will be seen that increasing the gravity of the 600° F.+ fraction about 2° API by hydrocracking (instead of by hydrofining as in Example 1) resulted in a substantial increase in the ratio of the 800° F.+/600°-800° F. fractions, instead of a decrease as in Example 1. This is further reflected in the increase in hydrogen content of 3.8 percent over the hydrogen content of the corresponding product in Run 1 of Example 1. The gas chromatograph simulated distillation data reported is depicted graphically in FIG. 1.

EXAMPLE 3

The procedure of Example 2 was repeated at a higher pressure and lower space velocities, the conditions and results being as follows:

Table 4

| Run No. | 4 | |
|---|---|---|
| | Hydrofiner | Hydrocracker |
| Temperature, ° F. | 783 | 783 |
| Pressure, psig | 2800 | 2800 |
| LHSV | 0.59 | 1.78 |
| $H_2$/Oil Ratio, MSCF/B | 9.05 | 9.05 |
| $C_6$+ Liquid Yields, Vol-% | | |
| $C_6$-185° F. | — | 1.7 |
| 185-400° | — | 17.8 |
| 400-600° | — | 25.9 |
| 600°+ | — | 57.2 |
| Product Properties | | |
| 185-400° F. Fraction | | |
| Aromatics, Vol-% | — | 41 |
| 400-600° F. Fraction | | |
| Aniline Point | — | 81.5 |
| Gravity, °API | — | 27.5 |
| 600° F.+ Fraction | | |
| Gravity, °API | ~21 | 24.4 |
| Hydrogen Content, Wt-% | — | 12.46 |
| Sulfur, ppm | — | 305 |
| Nitrogen, ppm | — | 100 |
| Total Aromatics, Wt-% | — | 48.8 |
| Gas Chromatograph Simulated Distillation of | | |

Table 4-continued

| Run No. | 4 | |
|---|---|---|
| Full-Range Product, Wt-% | | |
| $C_1$-$C_6$ | 0.17 | 1.18 |
| $C_7$-300° F. | 0.96 | 6.61 |
| 300-400° | 2.61 | 7.09 |
| 400-500° | 8.58 | 11.81 |
| 500-600° | 17.43 | 14.48 |
| 600-700° | 26.32 | 20.19 |
| 700-800° | 20.07 | 16.35 |
| 800-900° | 15.35 | 13.54 |
| 900°+ | 8.51 | 8.75 |
| Ratio of Fractions, 800° F.+/600-800° F. | 0.516 | 0.61 |

In this case, the hydrocracking step brought about a 3.4° API increases in gravity of the 600° F.+ fraction while still yielding an increased 800° F.+/600°-800° F. product fraction ratio. The hydrogen content of the 600° F.+ product was increased by 4.8 percent over the corresponding product from Run 2, Example 1.

EXAMPLE 4

In Examples 2 and 3, the feed was treated in a once-through manner. This example illustrates the conditions and results obtained in a run wherein the 400° - 600° F. product fraction was continuously recycled to the hydrocracking catalyst bed, with the hydrocracking temperature adjusted to give total conversion to 400° F. end-point gasoline and 600° F.+ catalytic cracker charge stock:

Table 5

| Run No. | 5 | |
|---|---|---|
| | Hydrofiner | Hydrocracker |
| Temperature, ° F. | 768 | 805.5 |
| Pressure, psig | 2800 | 2800 |
| LHSV | 0.45 | 1.80 |
| $H_2$Oil Ratio, MSCF/B | 9.92 | 9.91 |
| $C_6$+ Liquid Yields, Vol-% | | |
| $C_6$-185° F. | — | 10.0 |
| 185-400° | — | 42.7 |
| 400-600° | — | 0.0 |
| 600°+ | — | 39.9 |
| Product Properties | | |
| 185-400° F. Fraction | | |
| Aromatics, Vol-% | — | 46.9 |
| Octane No. F-1 + 3 ml TEL | — | 94.8 |
| 600° F+ Fraction | | |
| Gravity, °API | 21 | 25.8 |
| Hydrogen Content, Wt-% | — | 12.54 |
| Sulfur, ppm | — | 287 |
| Nitrogen, ppm | — | 80 |
| Total Aromatics, Wt-% | — | 38.4 |
| Gas Chromatograph Simulated Distillation of Full-Range Product, Wt.-% | | |
| $C_1$-$C_6$ | 0.16 | 1.59 |
| $C_7$-300° F. | 0.69 | 11.26 |
| 300-400° | 2.40 | 11.50 |
| 400-500° | 7.50 | 15.44 |
| 500-600° | 17.48 | 17.09 |
| 600-700° | 26.04 | 16.40 |
| 700-800° | 21.18 | 10.99 |
| 800-900° | 14.93 | 9.61 |
| 900°+ | 9.62 | 6.12 |
| Ratio of Fractions, 800° F.+/600-800° F. | 0.52 | 0.576 |

The foregoing data shows that with total recycle of the 400° - 600° F. fraction, not only is a high quality gasoline produced, but the 600° F.+ fraction is still further improved as a catalytic cracking charge stock, both in terms of API gravity and hydrogen content.

It is not intended that the invention should be limited to the details described herein, since many variations may be made by those skilled in the art without departing from the scope or spirit of the following claims:

We claim:

1. A process for the manufacture of high-octane gasoline products from an initial mineral oil feedstock containing less than 20 weight-percent of material boiling below 600° F and at least 20 weight-percent of material boiling above 800° F, and also containing condensed polyaromatic compounds, sulfur compounds and nitrogen compounds, which comprises:

1. subjecting said initial feedstock plus added hydrogen to catalytic hydrofining at elevated temperatures and pressures above about 1000 psig, in the presence of a hydrofining catalyst under hydrofining conditions correlated to give a substantial desulfurization and denitrogenation of said feedstock while synthesizing less than about 10 volume-percent of $C_6$-400° F. gasoline;
2. subjecting total effluent from step (1) to catalytic hydrocracking at temperatures between about 650° and 875° F. and pressures above about 1000 psig in the presence of a crystalline zeolite hydrocracking catalyst, and correlating the hydrocracking conditions so as to limit the synthesis of $C_6$-400° F. gasoline to between about 5 percent and 30 percent by volume and produce a hydrocracked product containing a higher weight ratio of material boiling above 800° F to material boiling between 600° and 800° F than was contained in the effluent from step (1), said zeolite hydrocracking catalyst consisting essentially of a Group VIB and/or Group VIII metal hydrogenating component supported on an aluminosilicate zeolite cracking base having relatively uniform crystal pore diameters between about 4 and 14 A and wherein the zeolite cations are mainly hydrogen ions and/or polyvalent metal ions;
3. recovering from the hydrocracked effluent a hydrocracked gasoline product and a catalytic cracking charge stock boiling above 400° F. and containing a substantial proportion of material boiling above 800° F., including the highest boiling fraction of said hydrocracked effluent;
4. subjecting said catalytic cracking charge stock to catalytic cracking at temperatures of about 850° - 1150° F. and pressures below about 1000 psig, and recovering therefrom a cracked gasoline product, an intermediate boiling range cycle oil, and a heavy bottoms fraction boiling mainly above 800° F.; and
5. withdrawing from the process at least a portion of said heavy bottoms fraction.

2. A process as defined in claim 1 wherein said hydrofining step (1) and said hydrocracking step (2) are carried out at pressures above about 2000 psig.

3. A process as defined in claim 1 wherein said hydrocracking catalyst comprises a Group VIII noble metal supported on a Y zeolite.

4. A process as defined in claim 1 wherein said hydrocracking conditions in step (2) are correlated so as to limit the synthesis of $C_6$-400° F. gasoline to between about 8 percent and 25 percent by volume.

5. A process as defined in claim 1 wherein said catalytic cracking charge stock recovered in step (3) boils essentially above 600° F., and wherein an aromatic light gas oil boiling between about 400° and 600° F. is also recovered.

6. A process as defined in claim 5 wherein said aromatic light gas oil is recycled to said hydrocracking step (2).

7. A process as defined in claim 5 wherein said aromatic light gas oil plus added hydrogen is subjected to separate hydrocracking substantially in the absence of ammonia and in the presence of a hydrocracking catalyst as defined in claim 1, to produce a high-octane gasoline product.

* * * * *

UNITED STATES PATENT OFFICE
CERTIFICATE OF CORRECTION

Patent No. 4,040,944 Dated August 9, 1977

Inventor(s) Arnold E. Kelley; Cloyd P. Reeg; Frederick C. Wood; George D. Cheadle It is certified that error appears in the above-identified patent and that said Letters Patent are hereby corrected as shown below:

Column 12, line 29, (claim 1) "zeolite" should read --zeolitic--;

Column 12, line 39, (claim 1) "1000 psig" should read --100 psig--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*